US009144320B1

(12) United States Patent
Baker

(10) Patent No.: US 9,144,320 B1
(45) Date of Patent: Sep. 29, 2015

(54) MODULAR POD MATTRESS

(71) Applicant: Roger Baker, Tulsa, OK (US)

(72) Inventor: Roger Baker, Tulsa, OK (US)

( * ) Notice: Subject to any disclaimer, the term of this patent is extended or adjusted under 35 U.S.C. 154(b) by 0 days.

(21) Appl. No.: 14/699,095

(22) Filed: Apr. 29, 2015

Related U.S. Application Data

(63) Continuation-in-part of application No. 14/266,931, filed on May 1, 2014.

(51) Int. Cl.
*A47C 27/00* (2006.01)
*A47C 27/06* (2006.01)

(52) U.S. Cl.
CPC ..... *A47C 27/001* (2013.01); *A47C 27/062* (2013.01); *A47C 27/064* (2013.01)

(58) Field of Classification Search
CPC ... A47C 27/001; A47C 27/062; A47C 27/064
USPC ..... 5/691, 720, 722, 723, 727
See application file for complete search history.

(56) References Cited

U.S. PATENT DOCUMENTS

| | | | |
|---|---|---|---|
| 1,276,361 | A | 8/1918 | Hobert |
| 1,528,066 | A | 3/1922 | McEntire |
| 3,031,690 | A | 5/1962 | Ramsay |
| 4,955,095 | A | 9/1990 | Gerrick |
| 5,393,938 | A | 2/1995 | Bumbalough |
| 5,471,688 | A | 12/1995 | Cavazos |
| 5,960,496 | A | 10/1999 | Boyd |
| 6,055,689 | A | 5/2000 | Cavazos |
| 6,122,787 | A | 9/2000 | Kao |
| 6,523,198 | B1 | 2/2003 | Temple |
| 7,454,810 | B2 | 11/2008 | Wells |
| 7,493,668 | B2 | 2/2009 | Piraino |
| 7,757,322 | B2 | 7/2010 | An |
| 7,861,342 | B1 | 1/2011 | Huang |
| 8,117,700 | B2 | 2/2012 | Howard |
| 8,181,296 | B2 | 5/2012 | Rawls-Meehan |
| 8,256,712 | B2 | 9/2012 | Sorensen |
| 8,370,979 | B2 | 2/2013 | Fukano |
| 2004/0255387 | A1 | 12/2004 | England |
| 2008/0098533 | A1 | 5/2008 | Erdman |

(Continued)

FOREIGN PATENT DOCUMENTS

WO WO 2010122625 A1 * 10/2010

OTHER PUBLICATIONS

Dual Custom Comfort Control beds | Natural Form® http://www.naturalform.com/n/4/dual-custom-comfort-controls.

*Primary Examiner* — Michael Trettel
(74) *Attorney, Agent, or Firm* — Head, Johnson & Kachigian, P.C.

(57) ABSTRACT

The invention relates to a modular pod mattress used for sleeping. The mattress includes a structural frame having bottom rails, guide rails and a dividing rail. A plurality of modular pods are secured to the frame to form the customized mattress that relates directly to the height and eight distribution of an individual's body parts to provide the maximum quality sleep environment unique to that individual. The modular pods include a plurality of spring members, which may have varying elasticity or resistant levels. The modular pods are supported by a support platform that prevents the pods from sagging or deflecting during use of the mattress. A horizontal scale system may be utilized to determine the specific weight of a particular body part, e.g., head, shoulders, thorax, buttocks, thighs, calves and feet, of the user.

20 Claims, 6 Drawing Sheets

(56) References Cited

U.S. PATENT DOCUMENTS

2009/0038080 A1 2/2009 Grigg
2009/0126107 A1 5/2009 Kuo
2009/0271925 A1 11/2009 Felix
2013/0239323 A1 9/2013 Schulz, Jr. et al.

* cited by examiner

MODULAR POD MATTRESS

CROSS REFERENCE TO RELATED APPLICATIONS

This application claims priority to and is a continuation-in-part of U.S. patent application Ser. No. 14/266,931, filed May 1, 2014, which is incorporated herein by reference in its entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A SEQUENCE LISTING, A TABLE, OR A COMPUTER PROGRAM LISTING APPENDIX

Not Applicable.

STATEMENT REGARDING PRIOR DISCLOSURES BY THE INVENTOR OR A JOINT INVENTOR

Not Applicable.

BACKGROUND OF THE INVENTION

1. Field of the Invention

This invention relates generally to a modular pod mattress, and more particularly, this invention relates to a mattress comprising a structural frame for securing modular pods in a predetermined arrangement depending upon on the height and the weight distribution of the user's body.

2. Description of the Related Art

A conventional sleeping mattress is typically limited in levels of comfort, and similarly limited to options customizable to the user's individual health, support and comfort needs. A conventional mattress is generally a uniform composition across the entire mattress. For instance, the mattress may have all firm pocket coils, or all soft pocket coils across the entire mattress. Although conventional mattresses may be chosen from limited options based upon consumer preference, i.e. firm, medium, or soft, they are usually not correctly fitted for differing distribution of the type of coils across the mattress corresponding with the type of coil needed for a particular portion of the user's body. For example, a person with back pain may need firmer or softer pocket coils in the area of the mattress supporting the back, as compared to the pocket coils supporting the leg portion of the body.

Further, when two people share a bed, it is difficult to customize a conventional mattress for both of the users' comfort needs. For instance, when a larger person shares a bed with a smaller person, a mattress is usually not fitted for both users' needs.

Further yet, over time conventional mattresses become worn, soiled and tend to sag. Once a mattress becomes worn, even if only in one portion, then the entire mattress is in need of being replaced and discarded. Conventional mattresses are large and heavy and therefore moving and replacing the mattress can be burdensome and difficult, as well as expensive. Further, disposing of the entire mattress can be wasteful and environmentally unsound.

Although prior patents have disclosed mattresses attempting to solve the above described problems they still fall short. For example, U.S. Pat. No. 7,493,668 B2, U.S. Pat. No. 6,055,689 and U.S. Pat. No. 7,757,322 each disclose a mattress with divisional support; however, they are limited to more generalized adjustable regions offering a limited amount of adjustability and particularity of support for each region of the body. With large general regions, the mattresses of the prior art cannot be customized or particular enough to provide adequate support in precise regions.

It is therefore desirable to provide a modular pod mattress that allows for support and elasticity that corresponds to the user's height and weight distribution and provides adequate support in particular and precise regions.

It is also desirable to provide a modular pod mattress that allows for adjustable corresponding support and elasticity to the user's height and weight distribution when the user's height and weight change over time.

It is also desirable to provide a modular pod mattress that allows for concurrent use by two different users of varying weight and height.

It is further desirable to provide a modular pod mattress that allows for easy and eco-friendly replacement.

It is yet further desirable to provide a modular pod mattress that allows for replacing only the portions of the mattress that needs to be replaced.

It is further desirable to provide a modular mattress that is easy to move and transfer from site to site by allowing for removal of associated parts separately, reducing the overall total weight of the mattress.

BRIEF SUMMARY OF THE INVENTION

In general, the invention relates to a modular pod mattress. According to a first aspect, the mattress includes a structural frame, a plurality of modular pods and at least one support platform. The structural mattress frame is constructed from a rigid bottom rail generally surrounding a lower perimeter of the mattress, a rigid dividing rail connected to the bottom rail, and a plurality of rigid guide rails connected to the bottom rail and the dividing rail. The modular pods are configured to be removably secured to the mattress frame, with each of the modular pods having a plurality of resistant members enclosed within a pod housing. The support platform is positioned intermediate of the resistant members of the modular pods and the mattress frame.

The resistant members may be encapsulated spring members, such as Marshall, pocket, coil, helical spring, bonnell, offset or continuous springs, and/or foam padding. The resistant members vary in elasticity and/or resistant levels, and may be color coded to indicate a particular elasticity and/or resistant level of the modular pod. In addition, the resistant members along an exterior perimeter of the mattress may form a sturdy vertical outer wall to prevent bulge. The mattress can also have exterior padding along an outer perimeter.

The support platform may be integrated into the modular pod and housed within the pod housing. The frame may be constructed from a plurality of longitudinal guide rails attached between a latitudinal dividing rail and the bottom rail, with the dividing rail extending generally along a midline of the mattress. Additionally, the frame can be constructed as two rigid sub-frames hingedly joined along the dividing rail of the mattress, such as by using an elongate hinge. The frame can be constructed from an aluminum alloy or a composite material.

According to a second aspect of the invention, the mattress includes a structural mattress frame having a pair of rigid mattress sub-frames hingedly joined along a latitudinal dividing rail. The dividing rail is positioned generally along a midline of the mattress frame, and each of the sub-frames having a plurality of longitudinal guide rails. The mattress also includes a plurality of modular pods removably securable to the frame. Each of the modular pods has a plurality of resistant members supported by a rigid support platform. The resistant members and the support platform are enclosed within a pod housing.

Similar to the first aspect, the sub-frames may be hingedly joined to the dividing rail about a fixed axis of rotation using an elongate hinge. Also, the resistant members may be encapsulated spring members, foam padding or a combination thereof, and the resistant members along an exterior perimeter of the mattress may form a sturdy vertical outer wall. The modular pods may be color coded to indicate a particular elasticity, resistant level or compressibility of the modular pod. The mattress may also include a detachable mattress topper removably securable to the mattress.

DETAILED DESCRIPTION OF THE INVENTION

Figure 1:
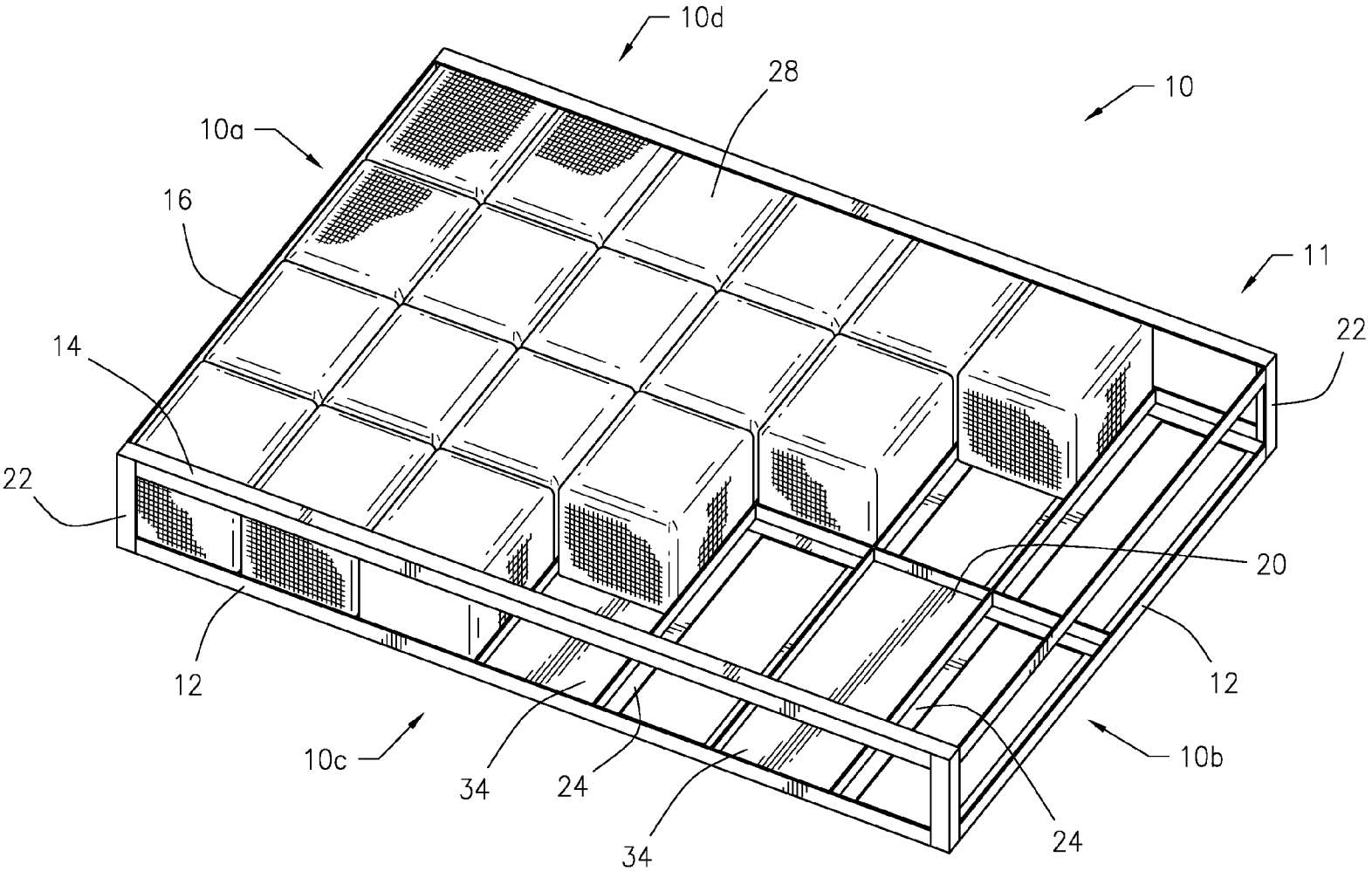
FIG. 1 illustrates a perspective view of an example of a modular pod mattress in accordance with an illustrative embodiment of the invention disclosed herein.

The devices discussed herein are merely illustrative of specific manners in which to make and use this invention and are not to be interpreted as limiting in scope.

While the invention has been described with a certain degree of particularity, it is to be noted that many modifications may be made in the construction and the arrangement of the structural and function details disclosed herein without departing from the scope of the invention. It is understood that the invention is not limited to the embodiments set forth herein for purposes of exemplification.

The description of the invention is intended to be read in connection with the accompanying drawings, which are to be considered part of the entire written description of this invention. In the description, relative terms such as "front," "rear," "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawings under discussion. These relative terms are for convenience of description and do not require that the machine be constructed or the method to be operated in a particular orientation. Terms, such as "connected," "connecting," "attached," "attaching," "join" and "joining" are used interchangeably and refer to one structure or surface being secured to another structure or surface or integrally fabricated in one piece.

Figure 2:
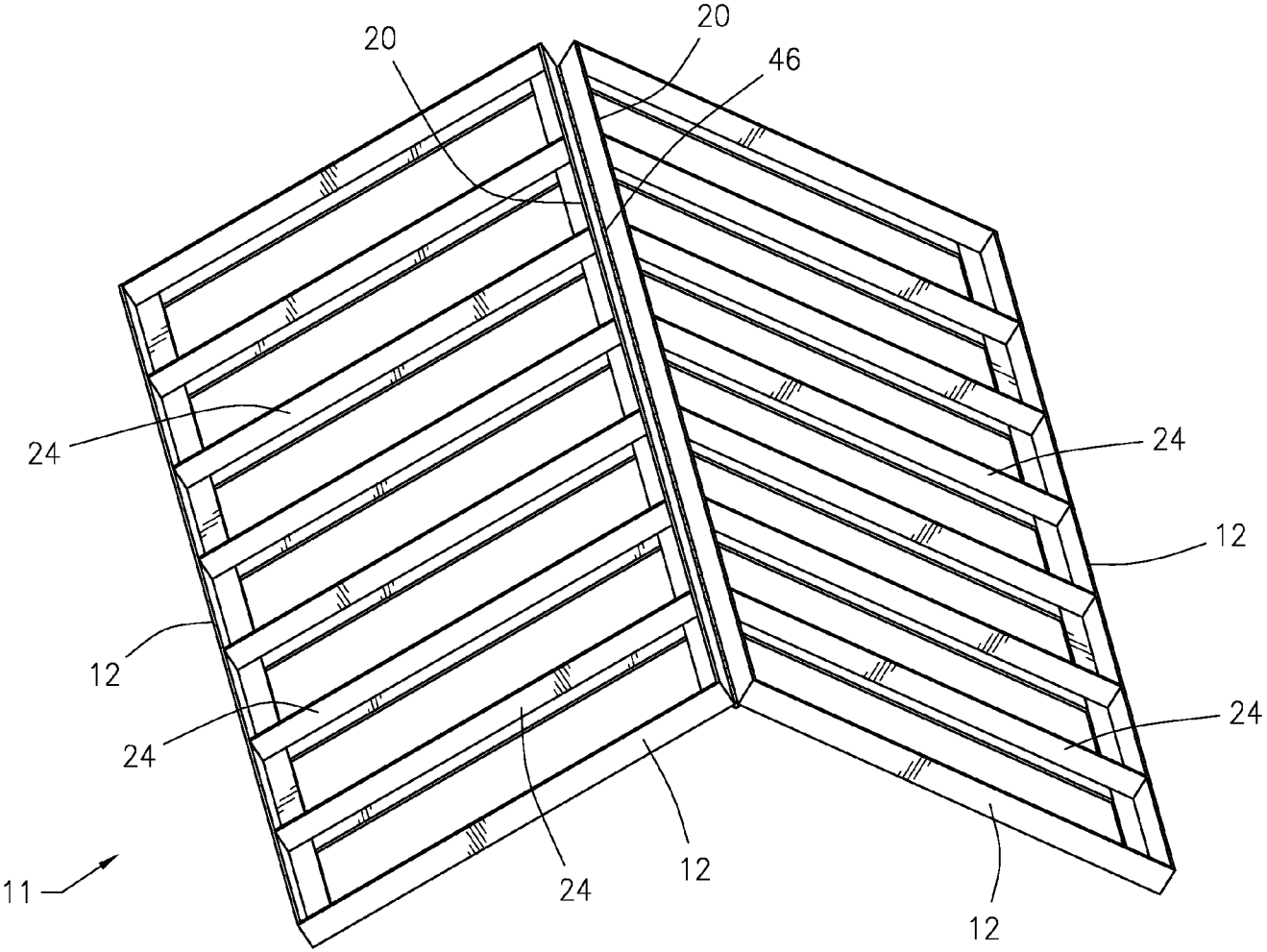
FIG. 2 illustrates a perspective view of an example of a structural frame in accordance with an illustrative embodiment of the invention disclosed herein.

Referring to the figures of the drawings, wherein like numerals of reference designate like elements throughout the several views, a modular pod mattress 10 has an upper end 10*a*, a lower end 10*b*, and sides 10*c* and 10*d*. The mattress 10 includes a plurality of modular pods 28 supported by a structural frame 11. The frame 11 includes bottom rails 12 that substantially surround the lower perimeter of the mattress 10. The frame 11 also includes a plurality of longitudinal guide rails 24 attached between a latitudinal dividing rail 20 and the bottom rails 12 extending along the sides 10*c* and 10*d* of the mattress 10. The dividing rail 20 extends from the upper end 10*a* to the lower end 10*b* generally along a midline of the mattress 10. As exemplified in FIG. 2, the frame 11 may be constructed as two (2) rigid sub-frames 11*a* and 11*b* hingedly joined along the dividing rail 20 of the mattress 10, such as by means of an elongate hinge 46. The hinge 46 enables sub-frame 11*a* to rotate relative to sub-frame 11*b* about a fixed axis of rotation in order to make the structural frame 11 of the mattress 10 more easily transportable. The frame 11 can be constructed of a lightweight, rigid support material, such as an aluminum alloy or composite material. Additionally, the frame 11 may include a lifting aid (not shown) to aid a user in lifting the frame 11, such as while making the mattress 10 up with bedding sheets.

As exemplified in FIG. 1, the frame 11 may also include corner rails 22 that are connected to and extend vertically perpendicular from perimeter corners of the bottom rails 12. In addition, the corner rails 22 can be connected to top rails 14, which extend along opposing sides 10*c* and 10*d* of the mattress 10. Two opposing rails 16 may be attached to corner rails 22 and opposing top rails 14. The opposing rails 16 respectively extend along the upper end 10*a* and the lower end 10*b* of the mattress 10. As illustrated, bottom rails 12, corner rails 22, and top side rails 14 may be generally "L" shaped having a general right angle or lip, and opposing rails 16 may be generally flat or planar. The guide rails 24 and the dividing rail 20 may be generally "T" shaped, which creates two opposing right angles for receipt of the pods 28. In this configuration, the structural frame 11 forms a subsurface platform rail system that guides, supports and stabilizes the modular pods 28. The modular pods 28 sit or rest upon the general "L" shape of the bottom rails 12. The guide rails 24 connect to the opposing bottom rails 12 and create intermediary support for the pods 28 to rest on. The generally "L" shaped top side rails 14 form an upper flange or lip. The modular pods 28 along longitudinal side 10*c* are therefore snuggly secured between the lip or flange of bottom rail 12 and the lip or flange of top side rail 14. The modular pods 28 in this position (alongside opposing longitudinal sides) cannot be lifted directly in the upwards position. Therefore, the modular pods 28 need to be slid along guide rails 24 toward the midline of the mattress 10 and then lifted upward to be removed. During use, the subsurface platform rail system prevents the pods 28 from shifting due to user movement and general ware.

Figure 3:
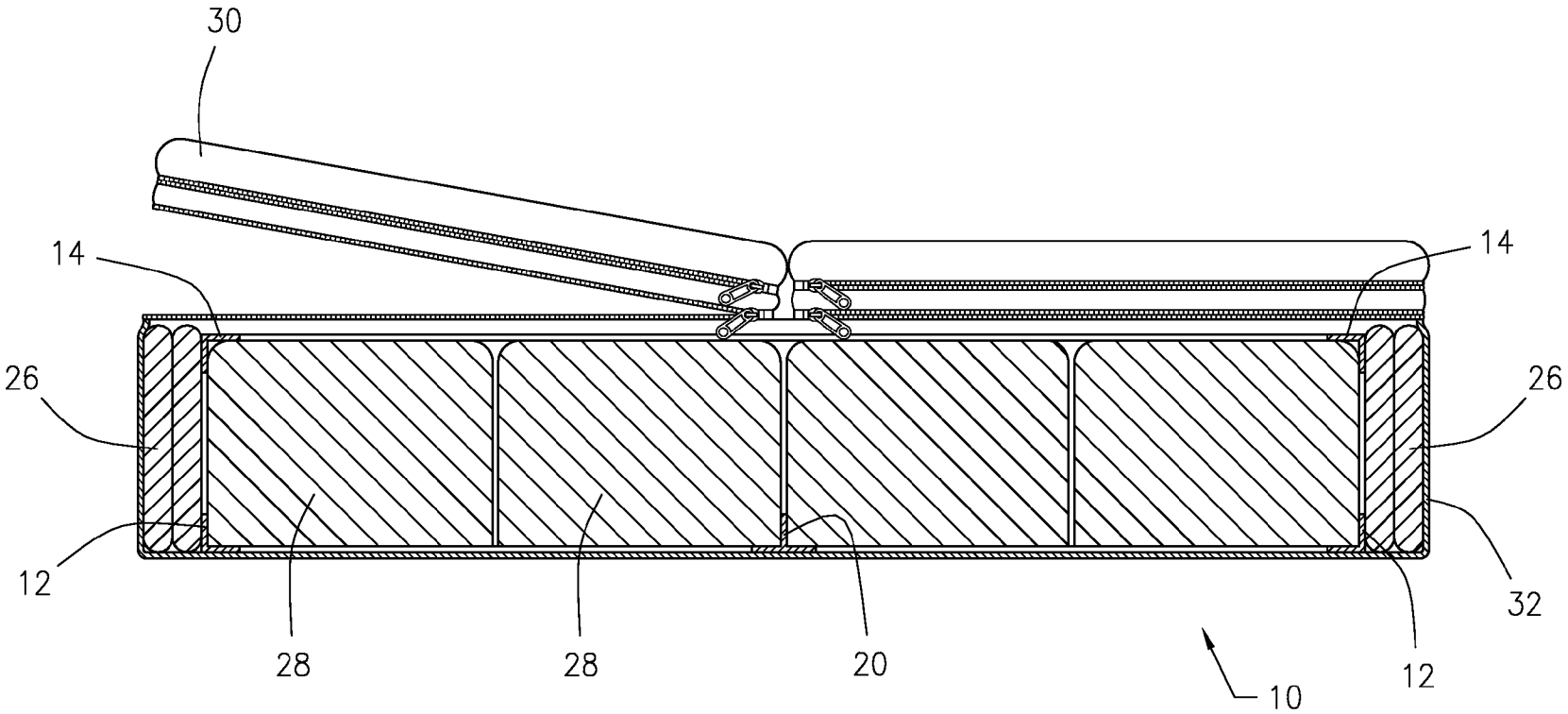
FIG. 3 illustrates a sectional view of the exemplary modular pod mattress shown in FIG. 1.

FIG. 3 illustrates a sectional view of the mattress 10 from the perspective of the lower end 10*b*. The modular pods 28 rest upon the frame 11 and are secured in place by the bottom rails 12, the dividing rail 20 and the guide rails 24. In this example, the modular pods 28 along the outer perimeter are also securely stationed between the flange of bottom rails 12 and top side rails 14. Exterior padding 26 may be used along the perimeter of the mattress 10 and/or the railing of the frame 11. The exterior padding 26 may be constructed from multiple layers of padding material, such as cotton, linen, twill, memory foam, gel foam, ticking or the like.

Figure 4:
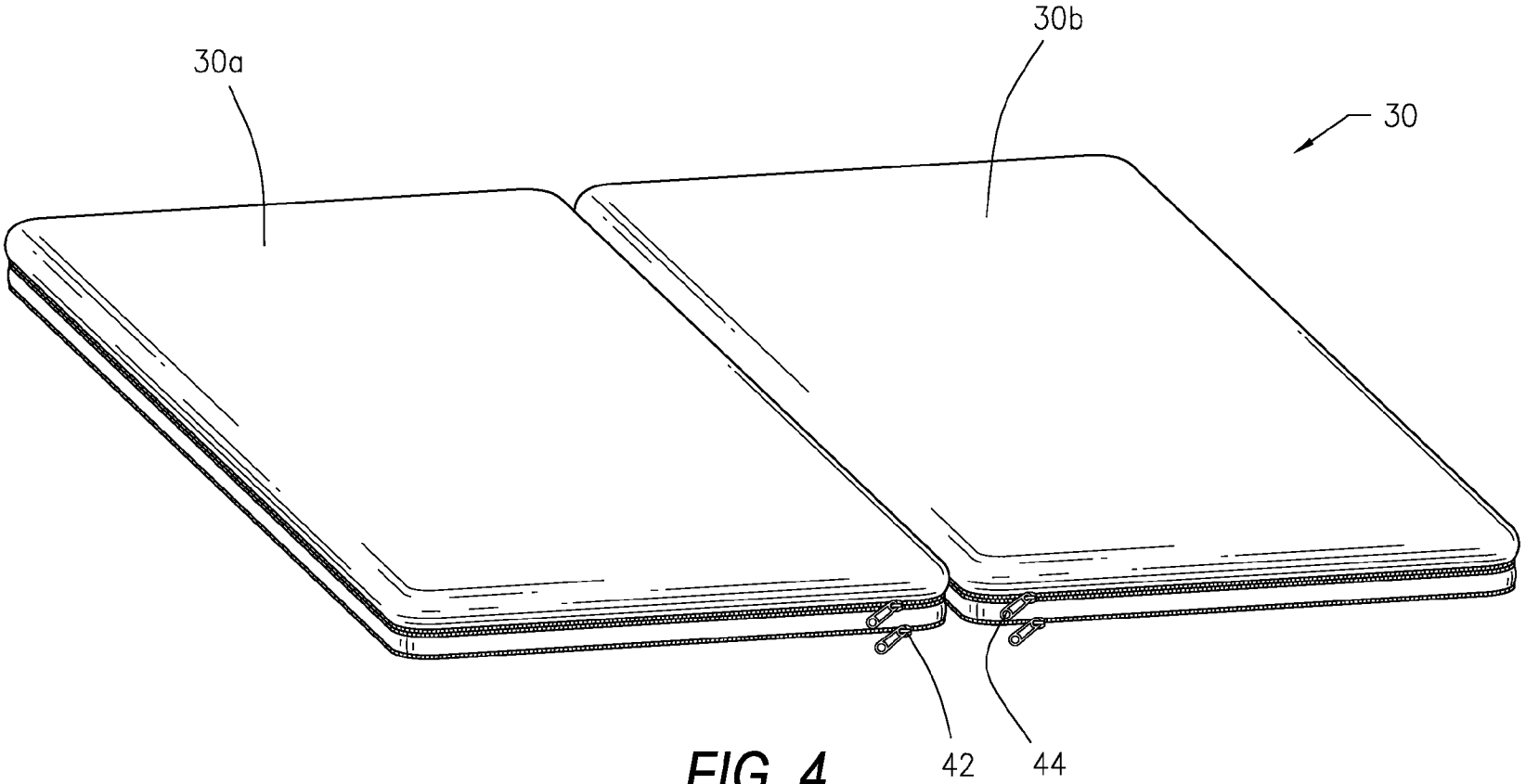
FIG. 4 illustrates a perspective view of an example of a detachable mattress topper in accordance with an illustrative embodiment of the invention disclosed herein.

The mattress 10, the frame 11 and/or the exterior padding 26 may be housed within a mattress cover 32, which may be constructed from suitable textile material. As illustrated in FIG. 4, a detachable mattress topper 30 may be removably secured to the mattress cover 32, such as by means of a zipper fastener 42. By way of example, the mattress cover 32 may enclose the modular pods 28 within a first compartment, while a mattress topper 30 may be enclosed within a second compartment of the mattress cover 32, such as using a zipper fastener 44. The first compartment may be opened in order to access the modular pods 28 in order to selectively remove or replace of the modular pods 28. Similarly, the second compartment surrounding the mattress topper 30 may be opened in order to selectively remove and replace the mattress topper 30. The detachable mattress topper 30 may be divided into two halves or sections, 30*a* and 30*b*, to optimize each user's needs.

Figure 5:
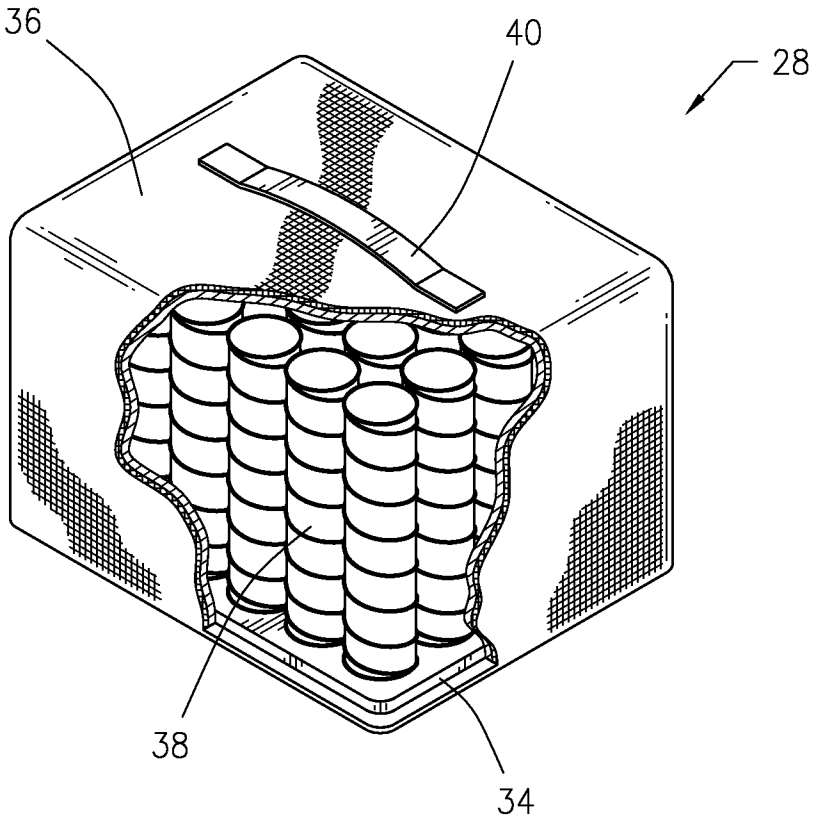
FIG. 5 illustrates a partial cut-away perspective view of an example of a mattress pod in accordance with an illustrative embodiment of the invention disclosed herein.

Referring now to FIG. 5, each modular pod 28 of the mattress 10 includes a plurality of spring members 38. The spring members 38 may be Marshall, pocket, coil, helical spring, bonnell, offset, continuous, or other type of encapsulated spring member, and/or the spring members 38 may include foam padding. The spring members 38 may have a variety of elasticity or resistant levels (e.g., soft; medium soft; medium; medium firm; and firm), which is achieved by the spring members 38 having varying wire strengths. A combination of differing resistant levels allows the pods 28, or zones of a particular pod 28, to have different compression rates when subjected to an equal amount of weight. In order to provide additional support about the perimeter of the mattress 10, the spring members 38 that line the exterior perimeter of the mattress 10 can have increased rigidity to provide a strong vertical outer wall to eliminate spring member 38 bulge. Alternatively, the modular pods 28 that line the exterior perimeter of the mattress 10 may include a resilient, sturdy foam lining (not shown) that prevents the spring member 38 from bulging and aids in holding the modular pods 28 to form a single integrated mattress 10.

The spring members 38 are supported by a support platform 34. The support platform 34 may removably engageable directly with the frame 11 (FIG. 1) or may be integrated into the modular pod 28 (FIG. 5), in order to provide complete support for the spring members 38. The platform 34 may be made or constructed of any suitable rigid, sturdy material, such as a polycarbonate material. The platform 34 is positioned intermediate of the frame 11 and the spring members 38, and does not allow the spring members 38 of the pods 28 to sag or deflect below the bottom of the frame 11 when a load is placed on the mattress 10.

The spring members 38 (and the support platform 34 if integrated into the pod 38) are bound within a housing 36, which is constructed from a heavy cloth material, such as muslin. The housing 36 retains the spring members 38, and if integrated into the pod 28, the platform 34. The housing 36 may include a handle 40 so that each modular pod 28 may be easily transported. Each modular pod 28 is constructed to be removable, customizable, and replaceable by the user. In addition, the pods 28 can be color coded based on elasticity so that the mattress 10 can be easily customizable, such as for use with medical beds or for customizable hotel beds.

Each modular pod 28 may be constructed of a similar size, such as one foot (1 ft.) in length and one and a half feet (1.5 ft.) in width and easily fit into and associate with the frame 11 of the mattress 10. As an example, for a standard sized California King, the mattress 10 may include four (4) modular pods 28 along the upper end 10*a* and seven (7) modular pods 28 along the side 10*c*; however, it should be appreciated that the dimensions of the modular pods 28 and the number of modular pods 28 may be manipulated and varied to allow for different sizes of mattresses, such as double, queen, or king.

The modular pod mattress 10 described herein is constructed so that a customizable comfort and support level is achieved for different people with varying weights and heights. The modular pod mattress 10 may also be paired with any type of available foundation such as a traditional box spring or low-profile bed platform.

Figure 6:
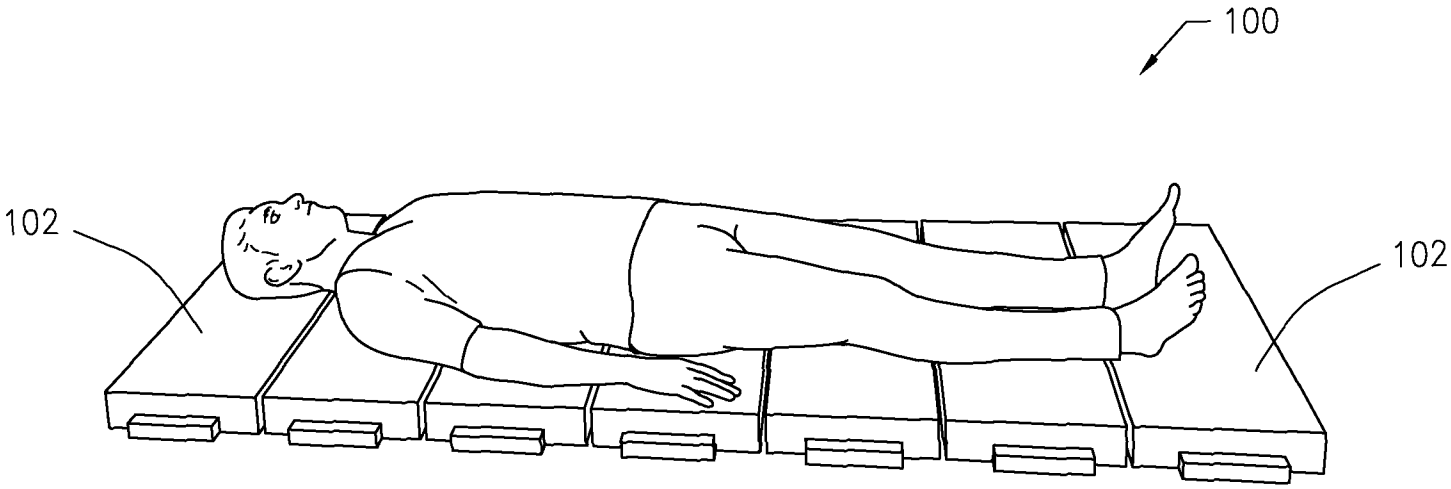
FIG. 6 illustrates a perspective view of an example of a horizontal scale system in accordance with an illustrative embodiment of the invention disclosed herein.

Turning now to FIG. 6, a horizontal scale system 100 that is divided into segments 102 such that each segment 102 can determine the specific weight of a particular body part, e.g., head, shoulders, thorax, buttocks, thighs, calves and feet, of the user. The horizontal scale system 100 enables the modular pod mattress 10 to be precisely correlated to the modular pod 28, namely to the specific load being created by that segment of the user's body or body part on that particular modular pod 28 during use. The support platform 34 enables the strength of spring members 38 necessary to support the individual's body part to be precisely determined and calculated. With the knowledge of the user's particular weight distribution, the modular pod mattress 10 can be customized to be ideally suited to that individual's height and weight. The horizontal scale system 100 provides necessary information to customize and personalize the mattress 10 to achieve the maximum comfortable sleep environment, better health, and a more productive and better quality of life.

After determining of the user's height and weight distribution using the horizontal scale system 100, each modular pod 28 with its calculated elasticity or resistant level may be oriented and arranged in the frame 11 of the mattress 10 to correspond with the weight distribution and particularized level of support needed for a corresponding region of the user's body in order to provide the maximum quality sleep environment unique to that individual. Over time, a user may gain or lose weight or need more support in a certain region, as such, the modular pods 28 may be removed and the spring members 38 may be replaced with a different type of spring member 38 or a spring member 38 having a different elasticity, depending on the user's particular needs and desires. The modular pods 28 are assembled into the frame 11 in order to provide a single integrated mattress 10 that allows for distinctive and precise levels of support and comfort for a corresponding region of a user's body.

Whereas, the devices have been described in relation to the drawings and claims, it should be understood that other and further modifications, apart from those shown or suggested herein, may be made within the scope of this invention.

What is claimed is:

1. A modular pod mattress, comprising:

a structural mattress frame, comprising:

a rigid bottom rail generally surrounding a lower perimeter of said mattress;

a rigid dividing rail connected to said bottom rail; and a plurality of rigid guide rails connected to said bottom rail and said dividing rail;

a plurality of modular pods configured to be removably secured to said mattress frame, each of said modular pods comprising a plurality of resistant members enclosed within a pod housing; and at least one support platform positioned intermediate of said resistant members of said modular pods and said mattress frame.

2. The mattress of claim 1 wherein said resistant members are encapsulated spring members and/or foam padding.

3. The mattress of claim 2 wherein said spring members are selected from the group consisting of Marshall, pocket, coil, helical spring, bonnell, offset or continuous springs.

4. The mattress of claim 2 wherein said resistant members vary in elasticity and/or resistant levels.

5. The mattress of claim 4 wherein said resistant members along an exterior perimeter of said mattress form a sturdy vertical outer wall.

6. The mattress of claim 4 wherein said modular pods are color coded to indicate a particular elasticity and/or resistant level of said modular pod.

7. The mattress of claim 1 wherein said pod housing comprises a heavy cloth material having a handle.

8. The mattress of claim 1 wherein said support platform is integrated into said modular pod and housed within said pod housing.

9. The mattress of claim 1 wherein said frame further comprises a plurality of longitudinal guide rails attached between a latitudinal dividing rail and said bottom rail.

10. The mattress of claim 9 wherein said dividing rail extends generally along a midline of said mattress.

11. The mattress of claim 1 wherein said frame further comprises two rigid sub-frames hingedly joined along said dividing rail of said mattress.

12. The mattress of claim 11 wherein said sub-frames are hingedly joined to said dividing rail using an elongate hinge.

13. The mattress of claim 1 wherein said frame is constructed from an aluminum alloy or a composite material.

14. The mattress of claim 1 further comprising a detachable mattress topper removably securable to said mattress.

15. The mattress of claim 1 further comprising exterior padding along an outer perimeter of said mattress.

16. A modular pod mattress, comprising:

a structural mattress frame comprising a pair of rigid mattress sub-frames hingedly joined along a latitudinal dividing rail, said dividing rail positioned generally along a midline of said mattress frame, each of said sub-frames having a plurality of longitudinal guide rails; and a plurality of modular pods removably securable to said frame, each of said modular pods comprising a plurality of resistant members supported by a rigid support platform, said resistant members and said support platform enclosed within a pod housing.

17. The mattress of claim 16 wherein said sub-frames are hingedly joined to said dividing rail about a fixed axis of rotation using an elongate hinge.

18. The mattress of claim 16 wherein said resistant members are encapsulated spring members, foam padding or a combination thereof.

19. The mattress of claim 16 wherein said resistant members along an exterior perimeter of said mattress form a sturdy vertical outer wall.

20. The mattress of claim 16 wherein said modular pods are color coded to indicate a particular elasticity, resistant level or compressibility of said modular pod.

* * * * *